United States Patent [19]

Raley et al.

[11] Patent Number: 4,550,546

[45] Date of Patent: Nov. 5, 1985

[54] STERILIZABLE PERFORATED PACKAGING MATERIAL

[75] Inventors: Garland E. Raley, Terre Haute, Ind.; Richard W. Goodrum, Richmond, Va.

[73] Assignee: Ethyl Corporation, Richmond, Va.

[21] Appl. No.: 651,449

[22] Filed: Sep. 17, 1984

Related U.S. Application Data

[63] Continuation-in-part of Ser. No. 423,956, Sep. 27, 1982, which is a continuation-in-part of Ser. No. 270,609, Jun. 5, 1981, abandoned, which is a continuation-in-part of Ser. No. 289,369, Aug. 3, 1981, abandoned.

[51] Int. Cl.[4] ..... B65B 55/10

[52] U.S. Cl. ..... 53/425; 206/439; 206/484.1; 206/484.2; 229/3.5 R; 383/101; 383/103; 422/34

[58] Field of Search ..... 47/1.1; 206/439, 484, 206/484.1, 484.2, 497, 524.1, 524.2, 524.3, 524.9; 229/3.5 R; 428/35, 101, 137, 178, 198; 383/94, 101–104; 53/403, 425; 422/28, 32, 34, 292, 294

[56] References Cited

U.S. PATENT DOCUMENTS

| | | | |
|---|---|---|---|
| 2,870,954 | 1/1959 | Kulesza | 206/524.8 |
| 3,054,148 | 9/1962 | Zimmerli | 264/504 |
| 3,625,348 | 12/1971 | Titchenal et al. | 206/484 |
| 3,628,720 | 12/1971 | Schmedding | 383/101 |
| 3,770,122 | 11/1973 | Thiele | 206/484 |
| 3,817,821 | 6/1974 | Gallini | 229/3.5 R |
| 3,929,135 | 12/1975 | Thompson | 604/385 |
| 4,247,584 | 1/1981 | Widiger | 206/524.2 |
| 4,270,658 | 6/1981 | Schuster | 206/484.1 |
| 4,272,473 | 6/1981 | Riemersma et al. | 264/154 |
| 4,276,330 | 6/1981 | Stanley et al. | 206/484 |
| 4,280,978 | 7/1981 | Dannheim et al. | 264/156 |
| 4,296,862 | 10/1981 | Armentrout et al. | 206/484.1 |
| 4,317,792 | 3/1982 | Raley et al. | 264/504 |
| 4,349,118 | 9/1982 | Sanderson et al. | 206/484 |

OTHER PUBLICATIONS

An Advertising Sheet of Visqueen Films Illustrating a Type of Film, No Date, 1 Page.

*Primary Examiner*—George E. Lowrance
*Assistant Examiner*—Jimmy G. Foster
*Attorney, Agent, or Firm*—Donald L. Johnson; John F. Sieberth; Paul H. Leonard

[57] ABSTRACT

A sterilizable, preferably fiber-free, perforated packaging material which can be utilized to make a package to hold an item which can be sterilized while it is inside the package comprising a first layer of perforated thermoplastic film, preferably extruded film, and having at least one heat-sealable surface, and a second layer of perforated thermoplastic film, preferably extruded film and having at least one heat-sealable surface, the first layer being oriented relative to the second layer so that the perforations in both of the layers are mis-aligned and at least one of the heat-sealable surfaces of one of the layers contacts at least one of the heat-sealable surfaces of the other layer; a package made from the packaging material; and a method of sterilizing an item in a package.

19 Claims, 10 Drawing Figures

STERILIZABLE PERFORATED PACKAGING MATERIAL

CROSS REFERENCE TO RELATED APPLICATIONS

This application is a continuation-in-part of application U.S. Ser. No. 423,956 filed Sept. 27, 1982, which in turn is a continuation-in-part of applications U.S. Ser. No. 270,609 filed June 5, 1981 now abandoned and U.S. Ser. No. 289,369 filed Aug. 3, 1981 now abandoned.

BACKGROUND OF THE INVENTION

The present invention is in the field of plastic films or sheets, especially perforated plastic films and is particularly concerned with sterilizable packaging material and packages made therefrom. Such packages are used as containers for sterile gauze and other types of wound dressings. The present invention is more particularly related to a material for packaging articles which can be sterilized after packaging.

In the medical field there are numerous applications and demands for sterile articles. Such articles include wound dressings such as gauze, cotton, and the like, and surgical instruments such as needles, scalpels, clamps, and the like. When packaging these materials, difficulties are encountered in maintaining the articles in a sterile condition while placing them in a package which will maintain the sterile condition. If an item must be handled by a packaging machine or packaging personnel after it is sterilized, there is the danger that the person or machine handling the item prior to packaging will contaminate the item.

Perforated plastic films having many useful applications, such as the manufacture of disposable diapers or other absorbent structures and in the packaging of foods or other materials.

Perforated plastic films have a plurality of relatively small or minute perforations therein with the perforations being located in small protuberances constructed in the film. Such perforated film generally has about 30 to about 1500 perforations per square inch or even more. The holes are of varied geometrical configurations, for example, rectangular or square shaped, pentagonal, hexagonal or other shape. The protuberances are also of various shapes, but are usually cone shaped or pyramid like.

One method of making perforated thermoplastic sheet or film is disclosed in U.S. Pat. No. 3,054,148, issued to Zimmerli. The patent discloses a stationary drum having a molding element mounted around the outer surface of the drum which is adapted to rotate freely thereon. A vacuum chamber is employed beneath the screen or molding element to create a pressure differential between the respective surfaces of the thermoplastic sheet to cause the plasticized sheet to flow into the perforations provided in the molding element and thereby cause a series of holes to be formed in the sheet.

Types of screens or molding elements are illustrated in U.S. Pat. No. 4,155,693.

U.S. Pat. No. 4,262,516 and U.S. Pat. No. 4,317,792 disclose apparatus and method, respectively for manufacturing thermoplastic sheet or film having elliptical holes.

It is highly desirable that a material be provided for making a package which can be used to maintain items in a sterile condition in which the items can be sterilized while actually inside the package.

In some cases even if sterilization standards are maintained, contamination can still occur when fibers break away from conventional packaging material such as coated paper and non-woven sheets made from polyolefin fibers. Such fibers can be dangerous if they should enter the sterile field and become entrapped in a wound or incision and thereby provide a situs for infection or irritation.

It is even more desirable that a non-fibrous material be provided for making the package which can be used to maintain items in a sterile condition and in which the items can be sterilized while actually inside the package.

It is therefore a primary object of the present invention to provide an aseptic package and materials and method for constructing the package.

The Invention

In accordance with the present invention there is provided a non-fibrous perforated packaging material which can be utilized to make a sterilizable package to hold an item which can be sterilized while it is inside the package, the packaging material including a first layer of perforated thermoplastic sheet or film, preferably extruded film, and a second layer of perforated thermoplastic sheet or film, preferably extruded film, the film layer being oriented relative to the second layer so that the perforations in one of the layers is misaligned with the perforations in the other of the layers. The package of the invention is made by placing an item to be packaged between two sheets of the packaging material of the invention and connecting or sealing the sheets at their edges and then sealing the non-perforated areas of one layer of the packaging material to the non-perforated areas of the other layer adjacent to it.

The packaging material of the present invention basically comprises two layers of perforated thermoplastic film which are positioned adjacent each other so that the perforations in one layer are misaligned with the perforations of the other layer. The perforated film of the invention is a truly porous material having a plurality of relatively small or minute perforations therein. Such film also has multiple bosses or protuberances with the bosses of one layer meshing with the bosses of the other layer. The perforations or holes are located in the protuberances. Typically, the perforated film has about 30 to 1500 perforations per square inch or even more.

U.S. Pat. No. 4,272,473 illustrates a suitable perforated film. The film has perforations of approximately 0.010 inch to 0.012 inch in diameter. The holes are at the apex of a truncated cone which has a base diameter of about 0.04 inch. The cones or bosses are closely packed.

The film of U.S. Pat. No. 4,280,978 has about 500 to 800 perforations or holes per square inch. The elliptical holes of the film U.S. Pat. No. 4,317,792 are closely spaced and have diameter axes of from about 17 to 19 mils to about 24 to 26 mils.

The film of U.S. Pat. No. 3,929,135 also has closely spaced holes whose diameter is about 0.004 to 0.1000 inch.

In a preferred form of the packaging material, the first layer of perforated thermoplastic film has at least one heat-sealable surface and the second layer of perforated thermoplastic film has at least one heat-sealable surface. At least one of the heat-sealable surfaces of one of the layers contacts at least one of the heat-sealable surfaces of the other layer.

Initially, the two layers of perforated film comprising the packaging material are not sealed together. Some spot sealing or gluing may be necessary to insure that the misalignment of the perforations is maintained until the sterilization process is completed. Since the perforated film of the packaging material has multiple bosses or protuberances, and the bosses of one layer more or less mesh with the bosses of another layer, the two layers are somewhat held together, at least, in a horizontal direction.

A minimum of two lamina are required, but a single layer may be made up of one lamina or several. Several lamina may be laminated together to form a single layer. Each layer is a perforated layer and each layer has a heat sealable surface. A heat sealable surface on one layer faces a heat sealable surface on the other layer.

The misalignment as explained in more detail hereinafter in effect aligns a non-perforated or solid or web portion of one layer with the openings or perforations of the other layer, with heat sealable solid areas around the perforations of a layer facing heat sealable solid areas of the other layer.

Such a packaging material formed of two layers permits gas to flow through the perforations in one layer through the perforations in the other layer to permit sterilizing an article contained in a package made of the packaging material. The package is sealed by heating the layers and causing the heat-sealable surfaces to fuse. Thus, an article which is desired to be sterilized can be placed in a package made from the material of the present invention, sterilized inside of the package by flowing steam or other high temperature liquids therethrough the perforations in the package layers, and then sealed in the package by heat sealing the two layers together. When the perforated film of the packaging material is extrusion formed, it is non-fibrous in nature and contamination from fibers is eliminated.

DESCRIPTION OF THE PREFERRED EMBODIMENTS

Figure 1:
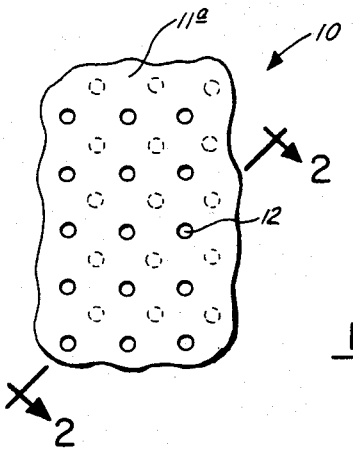
FIG. 1 is a top plan view of a segment of the packaging material of the present invention with the holes in the bottom layer shown by broken lines.

Referring now to the drawings, the packaging material can be seen in the drawings to be generally indicated by the numeral 10. The packaging material is made from two identical layers 11*a* and 11*b* of the same perforated extruded film.

Layer 11*a* refers to the top layer as shown in the drawings and layer 11*b* refers to the bottom layer. The top layer 11*a* has holes or perforations 12 therein in protuberances 12*a* and the bottom layer 11*b* has identical holes or perforations 12 therein. The protuberances 12*a* face away from each other in FIG. 2.

Layers 11*a* and 11*b* may be any desired plastic material such as polyethylene, polypropylene, and the like.

The two layers 11*a* and 11*b* are oriented so the perforations are misaligned. To maintain the orientation of the layers 11*a* and 11*b* prior to packaging an article, any means well-known in the art may be used such as clamping at the edges, sealing at the edges, spot sealing various small spots at different locations on the sheet, and the like.

Figure 3:
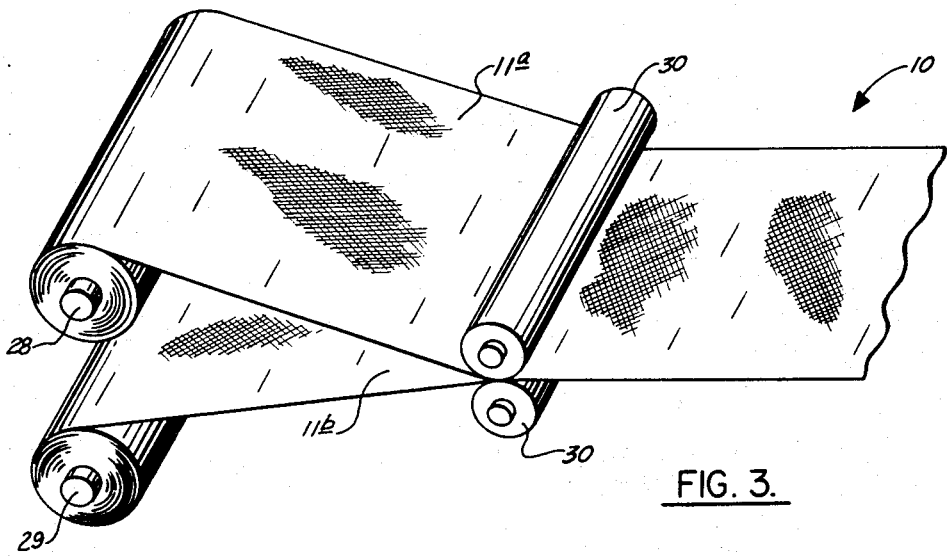
FIG. 3 is a schematic of a method of making the film of the present invention.

Also the method shown in FIG. 3 may be used to join the sheets. The film may be fed from rolls 28 and 29 to heated sealing rolls 30 to form sheet 10.

Figure 4:
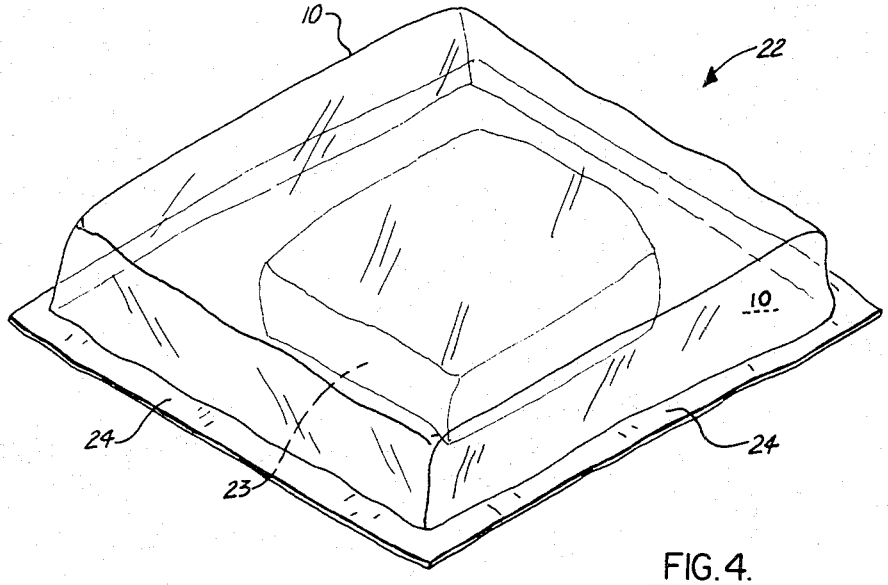
FIG. 4 is a perspective view of a package made from the material of the present invention.

A package 22 can be made from the material of the invention for holding an article 23 which is to be sterilized. Such a package is shown in FIG. 4, although any conventional package shape or design may be used. Two sheets of material 10 are shown enclosing the article 23 to be packaged and the edges 24 of sheets 10 being sealed by gluing, heat sealing, or the like.

Figure 2:
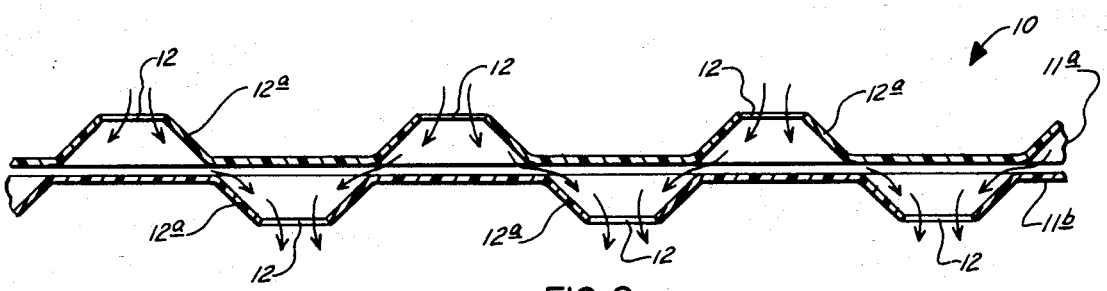
FIG. 2 is a cross-sectional view of the packaging material of the present invention taken along lines 2—2 of FIG. 1.

After the article is placed in the package, steam is then injected into the package as shown in FIG. 2 by the arrows. The steam travels in the direction of the arrows through the top holes 12 and out of the bottom holes 14 to heat and sterilize the article contained in the package.

It is thus seen that the packaging material of the present invention can be made to form a package in which an item can be placed and sterilized while actually in the package. The package is maintained in its sterile condition since no bacterial or other contaminants have a straight-line path to the interior of the package.

If desired, each layer 11*a* and 11*b* can be a laminate having more than two laminae. Furthermore, if desired, such layer 11*a* and 11*b* can have a different number of laminae, e.g., 11*a* could have two laminae and layer 11*b* could have three laminae, so long as the inside facing laminae are heat-sealable materials or other suitable sealable materials.

Figure 5:
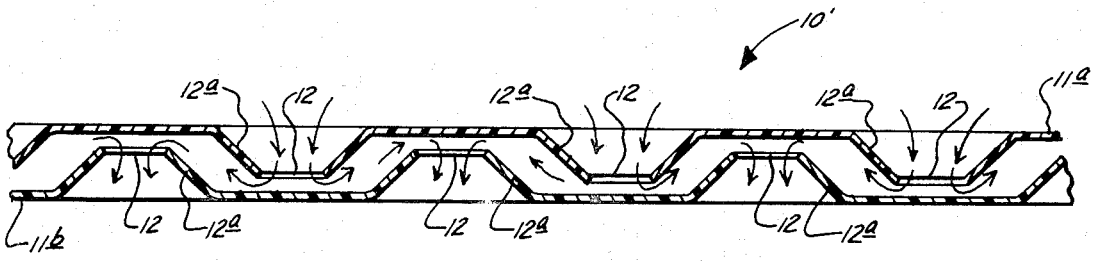
FIG. 5 is a cross-sectional view of another embodiment of the present invention.
Figure 6:
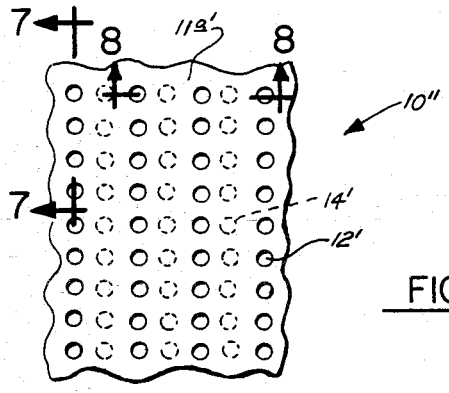
FIG. 6 is a top plan view of a segment of an alternate embodiment of the packaging material of the present invention with the holes in the bottom layer shown by broken lines.
Figure 7:
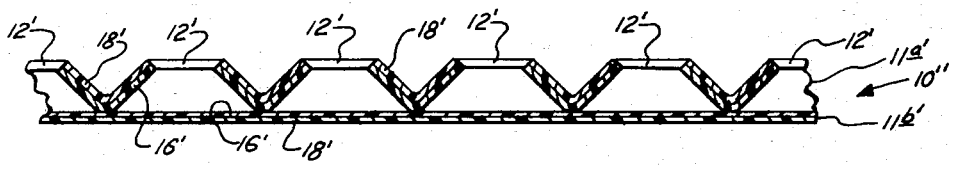
FIG. 7 is a cross-sectional view of the alternate embodiment of the packaging material of the present invention taken along lines 7—7 of FIG. 6.
Figure 8:
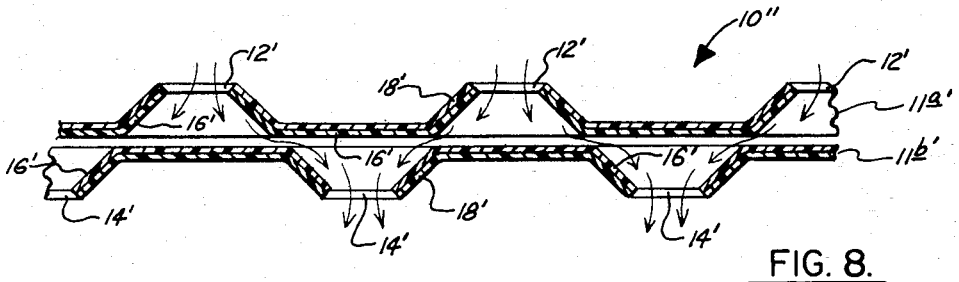
FIG. 8 is a cross-sectional view of the alternate embodiment of the packaging material of the present invention taken along lines 8—8 of FIG. 1.

In FIG. 5 is shown a preferred embodiment of the invention, generally indicated by the numeral 10'. In this embodiment, the protuberances 12*a* face each other and interlock, whereas, in FIG. 2 the protuberances 12*a* face away from each other.

In the embodiment as shown in FIG. 5, when the male side of one layer of film is adjacent the male side of another layer of film, welding, sealing, tacking, etc. of the layers together may not always be necessary. In some instances, the twisting air-path generated by such film arrangement provides a sufficient barrier to prevent contamination.

A dual laminae packaging material can be seen in FIGS. 6–10 of the drawings and is generally indicated by the numeral 10''. The packaging material is made from two identical layers 11*a'* and 11*b'* of the same perforated film.

Layer 11*a'* refers to the top layer as shown in the drawings and layer 11*b'* refers to the bottom layer. The top layer 11*a'* has holes or perforations 12' therein and the bottom layer 11*b'* has identical holes or perforations 14' therein.

Layers 11*a'* and 11*b'* each have an inner, heat-sealable lamina 16' and an outer lamina 18'. Lamina 16' may be any desired plastic material such a polyethylene, polypropylene, or the like. Lamina 18' may also be any desired plastic material which is heat-sealable such as low density polyethylene, vinyl acetate-ethylene copolymers, vinyl acetate-propylene copolymers, and like conventional polymers. By heat sealable is meant a material which will bond to itself when exposed to a heat source.

The two layers 11*a'* and 11*b'* are oriented so the heat-sealable layers 16' are touching and so that the perforations are misaligned. To maintain the orientation of the layers 11*a'* and 11*b'* prior to packaging an article, any means well-known in the art may be used such as clamping at the edges, sealing at the edges, spot sealing various small spots at different locations on the sheet, and the like.

Figure 10:
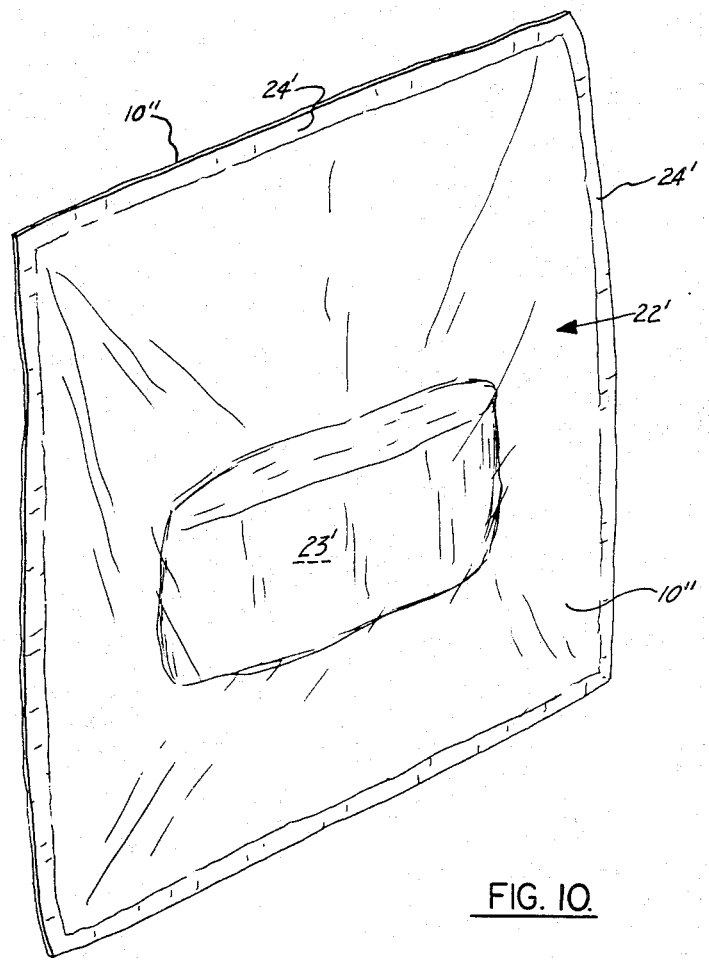
FIG. 10 is a perspective view of a package made from the alternate embodiment of the packaging material of the present invention.

A package 22' can be made from the material of the invention for holding an article 23' which is to be sterilized. Such a package is shown in FIG. 10, although any conventional package shape or design may be used. A sheet of material 10'' is shown folded about the article 23' to be packaged and the edges 24' sealed by gluing, heat sealing, or the like.

After the article is placed in the package, steam is then injected into the package as shown in FIG. 3 by the arrows. The steam travels in the direction of the arrows through the top holes 12' and out of the bottom holes 15' to heat and sterilize the article contained in the package.

Figure 9:
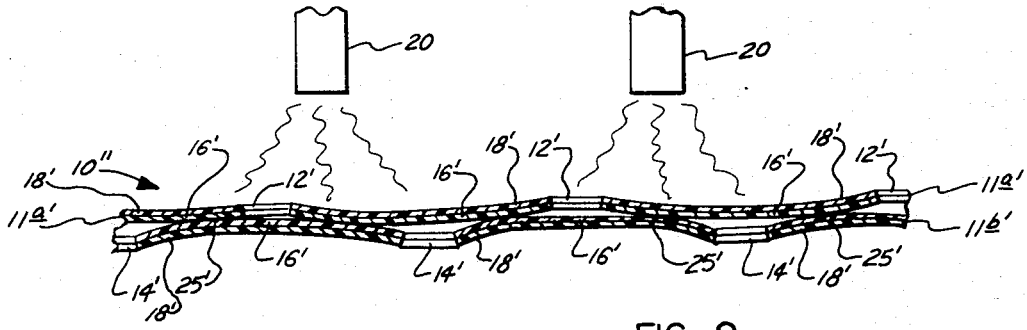
FIG. 9 is a cross-sectional view of the alternate embodiment of the packaging material of the present invention.

After the article is heated and sterilized, the entire package is placed in close proximity to heating elements 20 shown in FIG. 9. Heating elements 20 heat the inner layer 16' to a temperature sufficiently high to fuse the two layers as indicated at 25' in FIG. 9. The package is heated sufficiently to fuse layers 11*a'* and 11*b'* together so that no particles, bacteria, or other contaminants can travel into the package through orifices 12' and 15'.

It is thus also seen that dual laminae type packaging material of the present invention can readily be made to form a package in which an item can be placed and sterilized while actually in the package. The package is maintained in its sterile condition by exposure to heating source means which seals the area around all of the perforations in the sheets to prevent data contained in the package from being contaminated by any outside source of contamination.

If desired, each layer 11*a'* and 11*b'* could be a laminae having more than two laminae as long as the inside lamina 16' is a heat-sealable material. For example, if desired, one or more laminae may be placed on top of lamina 18'.

Furthermore, if desired, each layer 11*a'* and 11*b'* could have a different number of laminae, e.g., 11*a'* could have two laminae and layer 11*b'* could have three laminae, so long as the inside facing laminae are heat-sealable materials.

Packages made from the packaging material of the present invention can be made airtight and watertight after sterilization with steam or other gases. Neither air nor water can enter the package and contaminate the items inside after the package has been subjected to sufficient heat sealing.

A perforated thermoplastic film manufactured by the VisQueen Division of Ethyl Corporation identified as Vispore® film is particularly suitable for making the packaging material of this invention. Other similar types of perforated plastic films or sheets may be used, however such films must be so constructed that initially two layers thereof can be misaligned adjacent each other so as to permit sterilizing fluids to pass therethrough and after such fluid transmission to enable the two layers to be sealed together and inhibited from further fluid transmission.

Although the preferred embodiments of the invention have been disclosed and described in detail above, it should be understood that the invention is in no sense limited thereby and its scope is to be determined by that of the following claims.

What is claimed is:

1. A method for sterilizing an item in a package comprising:

a. placing the item between a fiber-free top sheet and a fiber-free bottom sheet of a sterilizable package, which package comprises said top sheet connected at its edges to said bottom sheet, said sheets being made from a material comprising a first layer of perforated thermoplastic extruded film and a second layer of perforated thermoplastic extruded film, said second layer of said film connected to said first layer of said film, said first layer of said film and said second layer of said film each having protuberances therein in which the perforations are located, and said first layer of said film being oriented relatively to said second layer of said film so that said perforations in said first layer of said film are mis-aligned with said perforations in said second layer of said film;

b. subjecting said package to a stream of sterilizing gas sufficient to enter the interior of said package and sterilize the item inside; and thereafter, c. subjecting said package to heat sufficient to seal the areas of said layers of film around said perforations in said package to each other and thereby make said package water-tight and airtight.

2. The method of claim 1 wherein said first layer of perforated film comprises a lamina of polyethylene.

3. The method of claim 1 wherein said first layer of perforated film is a layer of polyethylene.

4. The method of claim 1 wherein said protuberances of said first layer face said protuberances of said second layer.

5. the method of claim 1 wherein said protuberances of said first layer interlock with said protuberances of said second layer.

6. The method of claim 1 wherein said protuberances of said first layer face away from said protuberances of said second layer.

7. The method of claim 1 wherein said first layer is connected to said second layer by spot sealing.

8. The method of claim 1 wherein said first layer is connected to said second layer by gluing.

9. The method of claim 1 wherein said first layer is heat sealed to said second layer.

10. A method for sterilizing an item in a package comprising:

a. placing the item between the top sheet and the bottom sheet of a sterilizable package comprising a top sheet connected at its edges to a bottom sheet so that an item to be packaged may be placed between said sheets, said sheets being made from a material comprising a first layer of perforated thermoplastic extruded film having at least one heat-sealable surface, a second layer of perforated thermoplastic extruded film connected to said first layer having at least one heat-sealable surface, said first layer of said film and said second layer of said film each having protuberances therein in which the perforations are located, and said first layer of said film being oriented relative to said second layer of said film so that said perforations in said first layer of said film are mis-aligned with said perforations in said second layer of said film and said heat-sealable surfaces of each of said layers of film face each other;

b. subjecting said package to a stream of sterilizing gas sufficient to enter the interior of said package and sterilize the item inside; and thereafter, c. subjecting said package to heat sufficient to fuse said first layer and said second layer together and thereby seal the perforations in said package to make said package water-tight and airtight.

11. The method of claim 10 wherein said first layer of perforated film comprises a lamina of polyethylene having bonded thereto a lamina of a heat-sealable material.

12. The method of claim 11 wherein said heat-sealable material is a copolymer of vinyl acetate and ethylene.

13. The method of claim 10 wherein said first and second layers comprise a laminate having at least two laminae, at least one of which is a heat-sealable lamina, said heat-sealable laminae being on the inside of said layers, said two layers being oriented so that said heat-sealable laminae face each other.

14. The method of claim 10 wherein said first layer is connected to said second layer.

15. The method of claim 14 wherein said first layer is connected to said second layer by spot sealing.

16. The method of claim 14 wherein said first layer is connected to said second layer by gluing.

17. The method of claim 10 wherein said first layer is heat sealed to said second layer.

18. The method of claim 10 wherein said material is impervious to air.

19. The method of claim 10 wherein said material is impervious to water.

* * * * *

UNITED STATES PATENT AND TRADEMARK OFFICE

CERTIFICATE OF CORRECTION

PATENT NO. : 4,550,546

DATED : November 5, 1985

INVENTOR(S) : Garland E. Raley et al

It is certified that error appears in the above-identified patent and that said Letters Patent is hereby corrected as shown below:

Column 2, line 27, "film" should read -- first --; (3rd occurr.)

Column 6, line 57, "the" should read -- The --.

Signed and Sealed this

*Eleventh* Day of *February 1986*

[SEAL]

*Attest:*

DONALD J. QUIGG

*Attesting Officer*

*Commissioner of Patents and Trademarks*